United States Patent [19]

Kikkawa

[11] Patent Number: 4,756,720

[45] Date of Patent: Jul. 12, 1988

[54] PROCESS FOR PRODUCING A HIGH CONCENTRATION COAL-WATER SLURRY

[75] Inventor: Hirofumi Kikkawa, Kure, Japan

[73] Assignee: Babcock-Hitachi Kabushiki Kaisha, Tokyo, Japan

[21] Appl. No.: 22,520

[22] Filed: Mar. 9, 1987

Related U.S. Application Data

[63] Continuation of Ser. No. 622,233, Jun. 19, 1984, abandoned.

[30] Foreign Application Priority Data

May 6, 1983 [JP] Japan ..... 58-78352

[51] Int. Cl.[4] ..... C10L 1/32

[52] U.S. Cl. ..... 44/51

[58] Field of Search ..... 44/51

[56] References Cited

U.S. PATENT DOCUMENTS

| | | | |
|---|---|---|---|
| 2,346,151 | 4/1944 | Burk et al. | 44/51 |
| 3,762,887 | 10/1973 | Clancey et al. | 44/51 |
| 4,217,109 | 8/1980 | Siwersson et al. | 44/51 |
| 4,282,006 | 9/1981 | Funk | 44/51 |
| 4,330,301 | 5/1983 | Yamamura et al. | 44/51 |
| 4,398,919 | 8/1983 | Zakaria | 44/51 |
| 4,403,996 | 9/1983 | Matsuura et al. | 44/51 |
| 4,403,997 | 9/1983 | Poetschke | 44/51 |

*Primary Examiner*—William R. Dixon, Jr.
*Assistant Examiner*—Margaret B. Medley
*Attorney, Agent, or Firm*—Fay, Sharpe, Beall, Fagan, Minnich & McKee

[57] ABSTRACT

A process for producing a coal-water slurry having a high coal concentration, a low viscosity and a good stability is provided, which process comprises causing the slurry to have a composition of coal particles so that when the particles are divided into 8 fractions, each having a particle size range listed below, then the proportions by weight of the particles contained in the respective fractions, relative to the total weight of the particles contained in the slurry can fall within the following numeral value ranges:

| | | |
|---|---|---|
| $F_1$: | ($D_L/4$ to $D_L$) | 29.0 to 50.0% by weight |
| $F_2$: | ($D_L/4^2$ to less than $D_L/4$) | 20.0 to 25.0% by weight |
| $F_3$: | ($D_L/4^3$ to less than $D_L/4^2$) | 12.0 to 15.0% by weight |
| $F_4$: | ($D_L/4^4$ to less than $D_L/4^3$) | 6.0 to 10.0% by weight |
| $F_5$: | ($D_L/4^5$ to less than $D_L/4^4$) | 3.0 to 12.0% by weight |
| $F_6$: | ($D_L/4^6$ to less than $D_L/4^5$) | 1.5 to 5.2% by weight |
| $F_7$: | ($D_L/4^7$ to less than $D_L/4^6$) | 0.8 to 4.0% by weight |
| $F_8$: | ($D_L/4^7$ to 0) | 0.7 to 9.0% by weight |

wherein $D_L$ represents the maximum particle size.

14 Claims, 5 Drawing Sheets

PROCESS FOR PRODUCING A HIGH CONCENTRATION COAL-WATER SLURRY

This application is a continuation of application Ser. No. 622,233, filed June 19, 1984 now abandoned.

BACKGROUND OF THE INVENTION

Field of the Invention

This invention relates to a coal-water slurry, and more particularly it relates to a process for producing a coal-water slurry of the so-called good stability having a high coal concentration and a low viscosity with minimal settlings.

Recently coal has come to be actively used in place of petroleum mainly at thermal power stations. However, coal in the form of solid fuel is difficult to handle; hence large transport costs are required and there is a great influence on the cost of coal itself. Thus techniques by which coal is slurried to make it possible to handle coal in the form of fluid have been energetically developed. One of products thus developed is a mixture of heavy oil with coal (Coal and Oil Mixtures, hereinafter referred to as "COM"). In the case of COM, however, the ratio by weight of heavy oil to coal is about 1:1; thus COM cannot be regarded as a oil-free fuel and also its merit in respect of cost is small. Further, methacoal in the form of a mixture of methanol with coal also has a high cost; hence it has not yet been practically used.

On the other hand, CWM in the form of a mixture of coal with water (CWM: abbreviation of Coal-Water Mixtures) is sufficiently practical in respect of cost; hence it has recently been greatly noted. However, a problem raised in the combustion of CWM is the water content in CWM. As its combustion efficiency is concerned, naturally the lower the water content, the better the efficiency, and in the case of direct combustion, a water content of 30% or less is preferred. However, the lower the water content, the higher the viscosity of CWM; this raises a problem that when it is transported by way of pipeline or the like, the pressure loss increases.

Further, when CWM is practically used, a problem of storage is also raised. When CWM is stored in a usual tank, it is necessary for it to have a superior stability, but since CWM consists of coal particles and water, it is preferred to reduce their particle diameter, in order to inhibit coal particles from settling as much as possible. However, there is a tendency that when the particle diameter is reduced, the viscosity increases.

In order to overcome such drawbacks, it has been attempted to adjust the particle diameter distribution of coal particles to thereby prepare a CWM of the so-called good stability having a high coal concentration and a low viscosity with minimal settlings. However, coal particles are not completely spherical, and also the method of measuring the particle diameter of coal particles are various as follows: a method by means of sieves, a settling method represented by Andreasen Pipette, a method of analyzing the particle shapes by way of photographs of SEM (Scanning Electron Microscope) to calculate their representative diameter, etc. Thus, the definition of the particle diameter also varies depending on the measurement methods. This causes errors in adjusting the particle diameter distribution, and it becomes difficult to produce a CWM having a high coal concentration, a low viscosity and a good stability.

Now, the present inventors have considered that this problem might solved by adjusting the particle diameter distribution according to a method of measuring the particle diameter distribution regarded as most adequate, and have made extensive research. As a result, we have succeeded in obtaining the objective CWM having a high coal concentration, a low viscosity and a good stability.

The object of the present invention is to provide a process for producing a coal-water slurry having a high coal concentration, a low viscosity and a good stability.

SUMMARY OF THE INVENTION

The present invention is characterized briefly in that the particle diameter distribution of coal particles is measured relative to all the particle diameter ranges according to a definite method for measurement and then the particle diameter distribution is adjusted so as to reduce the viscosity of a coal-water slurry at high coal concentrations and make particle settling minimum i.e. improve the so-called stability.

The present invention resides in the following process:

In the process for producing a coal-water slurry having coal particles dispersed in water, a process for producing a coal-water slurry having a high coal concentration, a low viscosity and a good stability, which process comprises causing the slurry to have a composition of coal particles, so that when the coal particles are divided into 8 fractions ($F_1$, $F_2$, - - - and $F_8$), each having a particle diameter range listed below (($D_L/4 \sim D_L$), ($D_L/4^2 \sim$ less than $D_L/4$), - - - ($D_L/4^7 \sim 0$), wherein $D_L$ represents the maximum particle size of the coal particles), then the proportions by weight of the coal particles contained in the respective fractions, relative to the total weight of the coal particles contained in the slurry can fall within the following numeral value ranges:

| | | |
|---|---|---|
| $F_1$: | ($D_L/4$ to $D_L$) | 29.0 to 50.0% by weight |
| $F_2$: | ($D_L/4^2$ to less than $D_L/4$) | 20.0 to 25.0% by weight |
| $F_3$: | ($D_L/4^3$ to less than $D_L/4^2$) | 12.0 to 15.0% by weight |
| $F_4$: | ($D_L/4^4$ to less than $D_L/4^3$) | 6.0 to 10.0% by weight |
| $F_5$: | ($D_L/4^5$ to less than $D_L/4^4$) | 3.0 to 12.0% by weight |
| $F_6$: | ($D_L/4^6$ to less than $D_L/4^5$) | 1.5 to 5.2% by weight |
| $F_7$: | ($D_L/4^7$ to less than $D_L/4^6$) | 0.8 to 4.0% by weight |
| $F_8$: | ($D_L/4^7$ to 0) | 0.7 to 9.0% by weight |

DESCRIPTION OF THE PREFERRED EMBODIMENTS

The present invention will be described referring to the accompanying drawings.

Coal is ground in the wet or dry manner by means of a mill and a part of the resulting particles is taken to measure their particle size distribution. In measuring the particle size distribution, it was considered that the weight proportion of finely divided particles had a great influence upon the viscosity and the stability relative to setting of slurry; thus in an example, the particles were divided into the following 8 fractions (each a constituent part as a group), and the respective fractions were each sieved by a sieve most adequate thereto (e.g. sieve according to JIS standards or millipore filter having the particle size well adjusted) to measure the weight of the fraction.

In the following list, $D_L$ represents the maximum particle diameter of particles. $F_1 \sim F_8$ represent symbols of the respective fractions.

| | Particle diameter range |
|---|---|
| $F_1$: | $D_L/4 \sim D_L$ |
| $F_2$: | $D_L/4^2 \sim$ less than $D_L/4$ |
| $F_3$: | $D_L/4^3 \sim$ less than $D_L/4^2$ |
| $F_4$: | $D_L/4^4 \sim$ less than $D_L/4^3$ |
| $F_5$: | $D_L/4^5 \sim$ less than $D_L/4^4$ |
| $F_6$: | $D_L/4^6 \sim$ less than $D_L/4^5$ |
| $F_7$: | $D_L/4^7 \sim$ less than $D_L/4^6$ |
| $F_8$: | less than $D_L/4^7$ |

In the present invention, particles were divided into 8 fractions for measurement, but the number of fractions is not always limited to 8, but practically it may be 5 to 15 unless the distribution of the particle sizes changes.

More than one kind of coal or coal slurry were mixed so that the constituent proportions by weight of $F_1 \sim F_8$ might have a certain value, respectively, and if necessary, water was added for adjusting the water content, to study their viscosities. In this case, if the maximum particle size $D_L$ is too large, the amount of unburned matter at the time of combustion increases, while if it is too small, the slurry viscosity increases; hence the maximum particle size $D_L$ was made 44 to 420 μm.

Figure 1:
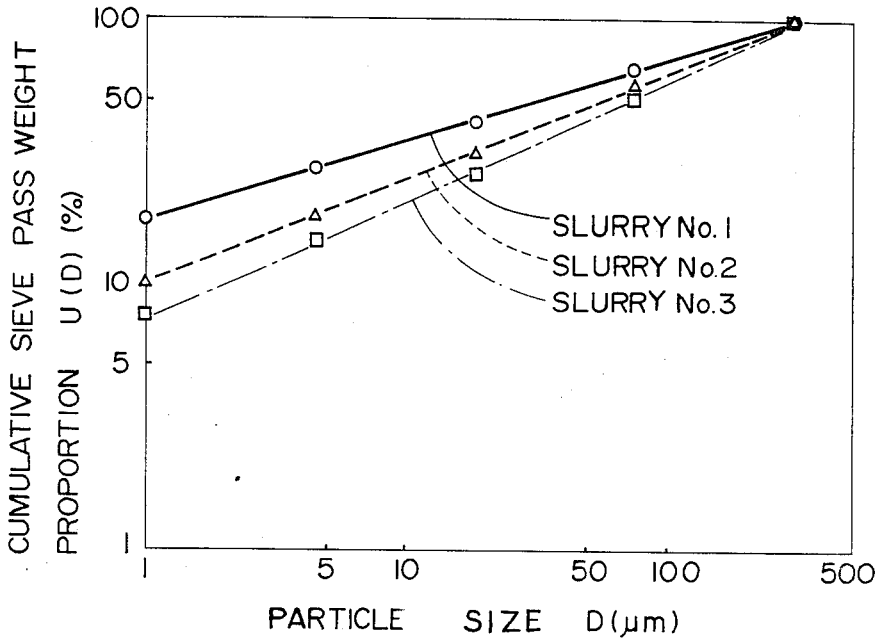
FIG. 1 shows a chart illustrating the particle sizes of low viscosity slurries and cumulative particle diameter distributions thereof.

Further, a certain kind of coal was chosen and the proportions of fractions were varied to study the influence upon viscosity. Further, when proportions of fractions exhibiting a relatively low viscosity were converted into cumulative distributions, a tendency was found. FIG. 1 shows a chart illustrating the relationship between the particle size and the cumulative sieve pass weight proportion in the case where three kinds of slurries (No. 1~No. 3) were prepared from coal A (bituminous coal, ash content 9.5%). There are shown cumulative particle size distributions in the case of a coal concentration of 70% and 1,000 cP viscosity or less. In this case, the particle size D is 297 μm and only distributions of particle sizes of 1 μm or larger are shown. Further, the slurry viscosity refers to numeral values obtained when an inner cylinder-rotation type viscometer was rotated at a shear rate of 90 $sec^{-1}$ for 5 minutes. It is seen from FIG. 1 that the proportions in the case of 1 μm or more each constitute a nearly straight line. Further, when the cumulative sieve weight proportion U(D)% is 100% at $D=D_L$, $D_s$ (minimum particle diameter) at which U(D)=0% should be present. Thus, we propose the following equations (1) and (2) as those indicating a particle size distribution mode of coal particles contained in a slurry exhibiting a low viscosity at a high coal concentration:

$$U(D) = \left(\frac{D - D_s}{D_L - D_s}\right)^q \times 100\% \quad (1)$$

$$U(D) = \frac{D^q - D_s^q}{D_L^q - D_s^q} \times 100\% \quad (2)$$

wherein q represents an index.

In both the equation (1) and (2), when $D=D_L$, U(D)=100%, and when $D=D_s$, U(D)=0%. That is, these equations correspond well to practical particle size distributions.

If $D_s=0$ in the equation (1) and (2), the equations both give the following equation (3):

$$U(D) = \left(\frac{D}{D_L}\right)^q \times 100\% \quad (3)$$

This equation (3) corresponds to Andreasen's equation which has been known as a particle size distribution equation giving the closest packing for powder of a continuous particle size system. As to this Andreasen's equation, studies were made in the past, and it was confirmed that when q=0.35~0.40, the percentage packing attains the maximum. The percentage packing, however, varies depending on particle shapes, and as to the systematic relationship between the q value and the slurry viscosity and stability of coal-water slurry, no study has never been made. Further, Andreasen's equation is a distribution equation in the case where particles having an infinitesimal particle diameter were presumed, but the equation cannot be, as it is, applied to practical coal-water slurry. Whereas, the present inventors confirmed that the equation (1) and (2) correspond well to practical distributions.

Figure 2:
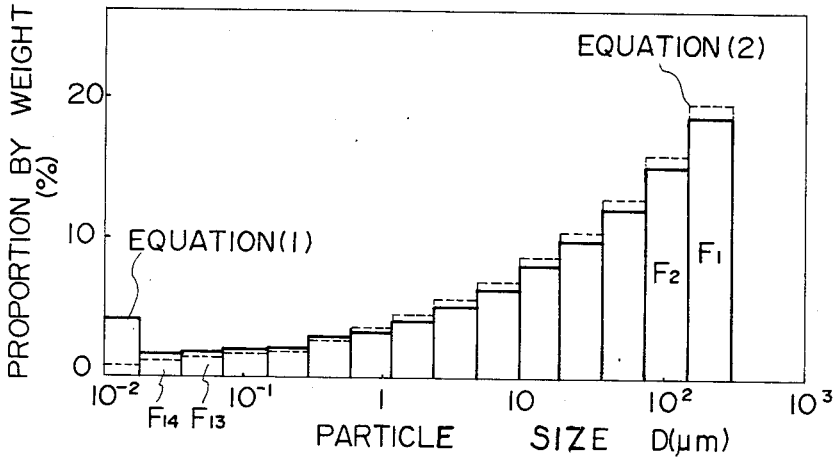
FIG. 2 shows a bar chart illustrating particle size and proportions by weight of the respective fractions.

FIG. 2 shows the weight proportions of the respective fractions in the case where $D_L$=297 μm, $D_s$=0.01 μm and q=0.3 in the equations (1) and (2). In this case, in order to compare the particle diameters more strictly, particles were divided into the following 15 fractions (dotted lines in FIG. 2 indicate the case of the equation (2) and solid lines therein indicate the case of the equation (1)):

| | Particle size range |
|---|---|
| (1) $F_1$: | $D_L/2 \sim D_L$ |
| (2) $F_2$: | $D_L/2^2 \sim$ less than $D_L/2$ |
| (3) $F_3$: | $D_L/2^3 \sim$ less than $D_L/2^2$ |
| (4) $F_4$: | $D_L/2^4 \sim$ less than $D_L/2^3$ |
| (5) $F_5$: | $D_L/2^5 \sim$ less than $D_L/2^4$ |
| (6) $F_6$: | $D_L/2^6 \sim$ less than $D_L/2^5$ |
| (7) $F_7$: | $D_L/2^7 \sim$ less than $D_L/2^6$ |
| (8) $F_8$: | $D_L/2^8 \sim$ less than $D_L/2^7$ |
| (9) $F_9$: | $D_L/2^9 \sim$ less than $D_L/2^8$ |
| (10) $F_{10}$: | $D_L/2^{10} \sim$ less than $D_L/2^9$ |
| (11) $F_{11}$: | $D_L/2^{11} \sim$ less than $D_L/2^{10}$ |
| (12) $F_{12}$: | $D_L/2^{12} \sim$ less than $D_L/2^{11}$ |
| (13) $F_{13}$: | $D_L/2^{13} \sim$ less than $D_L/2^{12}$ |
| (14) $F_{14}$: | $D_L/2^{14} \sim$ less than $D_L/2^{13}$ |

-continued

| | Particle size range |
|---|---|
| (15) $F_{15}$: | less than $D_L/2^{14}$ |

It is seen that the case of the equation (1) is different from that of the equation (2) in that the proportion of finely divided particles is higher and there are minimum points $F_{13}$ and $F_{14}$, where the weight proportion becomes minimum.

Thus, the present inventors varied the values of $D_L$, $D_s$ and q in the equations (1) and (2) to study their influences upon the viscosity and stability of slurry, whereby many findings could be obtained.

From these findings, coal-water slurry of the present invention is preferably composed so that diameter distribution of coal particles having particle diameters in the range of 1,000 μm to 0.005 μm substantially satisfies the following equation and the following ranges of numeral values:

$$U(D) = \left(\frac{D - D_s}{D_L - D_s}\right)^q \times 100 \quad (1)$$

$$D_L = 44 \sim 1{,}000\ \mu m \quad (2)$$

$$D_s = 0.005 \sim 0.1\ \mu m \quad (3)$$

$$q = 0.25 \sim 0.50 \quad (4)$$

wherein D represents a particle size of coal particles; $D_L$, the maximum particle size thereof; $D_s$, the minimum particle size thereof; and q, an index.

Further, the slurry is preferably composed so that coal particles of 1 μm or less can be present in an amount of 5 to 46% by weight and those of 0.05 μm or less can be present in an amount of 0.5% or more, more preferably 1% or more.

Further, it is preferable that the coal-water has a coal content of 60 to 80% by weight and a viscosity of 5,000 cP or less, in terms of numeral values obtained when an inner cylinder-rotation type viscometer is rotated at a shear rate of 90 $sec^{-1}$ for 5 minutes.

Coal-water slurry of the present invention may contain at least one kind of anionic dispersant selected from the group consisting of naphthalenesulfonic acid, orthophosphoric acid, polyphosphoric acids represented by $H_{n+2}P_nO_{2n+1}(n \geqq 2)$ or $H_nP_nO_{2n}(n \geqq 3)$, tartaric acid, oxalic acid, citric acid, ethylenediamine tetraacetate, ligninsulfonic acid, salts or condensates of the foregoing, tannins including quebracho-tannin and metal salts of carboxymethylcellulose, as a dispersant for coal particles in an amount of 3% by weight, or less, preferably 1.5% or less, based on the weight of the coal weight.

Further, at least one kind of pH-adjustors selected from the group consisting of sodium hydroxide, potassium hydroxide, barium hydroxide and sodium carbonate is added to the slurry as a pH-adjustor for rendering the pH value of the slurry 7 or more, in an amount of 3% or less, preferably 1.5% or less, based on the coal weight.

The present invention will be described in more detail by way of Examples.

EXAMPLE 1

Figure 3:
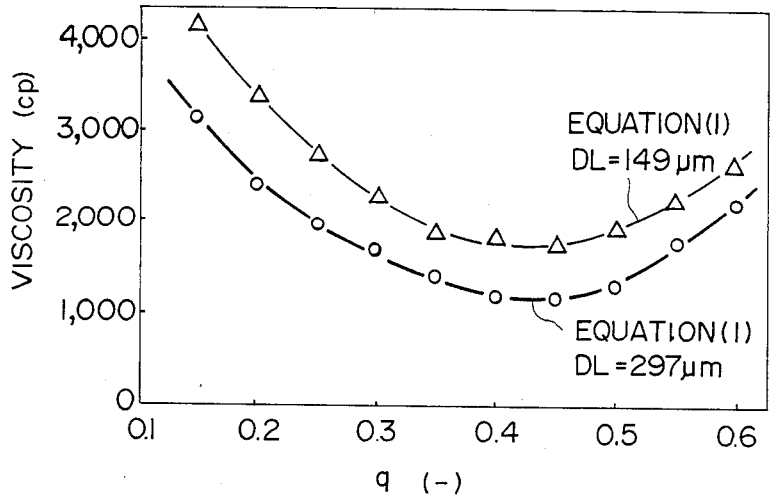
FIG. 3 shows a diagram illustrating the relationship between particle diameter distributions and slurry viscosities.

With coal A (bituminous coal, ash content 9.5%), the proportions of the respective fractions were adjusted according to the above-mentioned method to prepare 20 kinds of coal samples having particle size distributions corresponding to $D_L$=297 μm and 149 μm, $D_s$=0.01 μm and g=0.15, 0.20. 0.25, 0.30, 0.35, 0.40, 0.45, 0.50, 0.55 and 0.60 in the equation (1), followed by preparing a slurry having a coal concentration of 72% by adjusting water content from the respective samples, thereafter adding a poly-sodium naphthalenesulfonate as dispersant in an amount of 0.5% based on the coal weight and sodium hydroxide as pH adjustor in an amount of 0.1% based thereon and measuring their slurry viscosities. The results are shown in FIG. 3. It was observed that the viscosities became minimum at q=0.40~0.45 irrespective of D.

The same studies were made as to the equation (2) to similarly give the minimum viscosities at q=0.40~0.45. Further, it was observed that the viscosity values, too, accorded nearly with the above in the case of the same values Of $D_L$, $D_s$ and q.

Further, the same studies were made on other kinds of coals to give the minimum viscosities at q=0.40~0.50.

EXAMPLE 2

Figure 4:
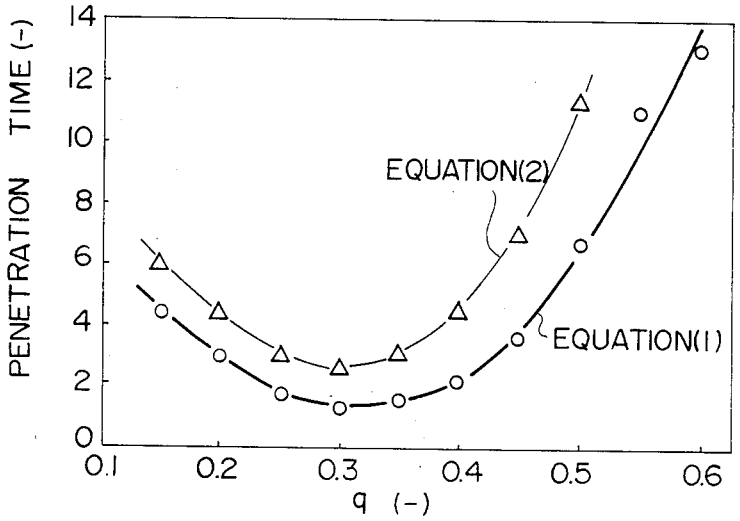
FIG. 4 shows a chart illustrating the relationship between particle size distributions and stability.

With the same slurries as in Example 1, their stabilities were studied. Each of the slurries was placed in a 500 ml graduated cylinder up to a depth of 170 mm, followed by allowing a glass stick of 5 mm in diameter and 10 g in weight to penetrate thereinto only by its self weight to observe the change in the penetration time during which the stick reached the bottom of the cylinder. FIG. 4 shows the relationship between the penetration time at the time when 30 days lapsed after preparation of the slurries (the penetration time just after the preparation being made 1), and the q value. Namely FIG. 4 shows comparison of stabilities as to the slurries having viscosities shown in FIG. 3 and $D_L$=297 μm. The penetration time became minimum at q=0.25~0.35, and it is seen that the penetration time is shorter and the stability is superior in the case of the equation (1) as compared with those in the case of the equation (2).

Other kinds of coals were studied varying $D_L$, etc. to obtain similar results.

It was found through Examples 1 and 2 that slurries according to the equation (1) were superior in stability to those according to the equation (2) and they exhibited equal values as to viscosity. Further it was found that in view of viscosity and stability, particle size distributions at q=0.25~0.50 in the equation (1) were preferable.

EXAMPLE 3

Figure 5:
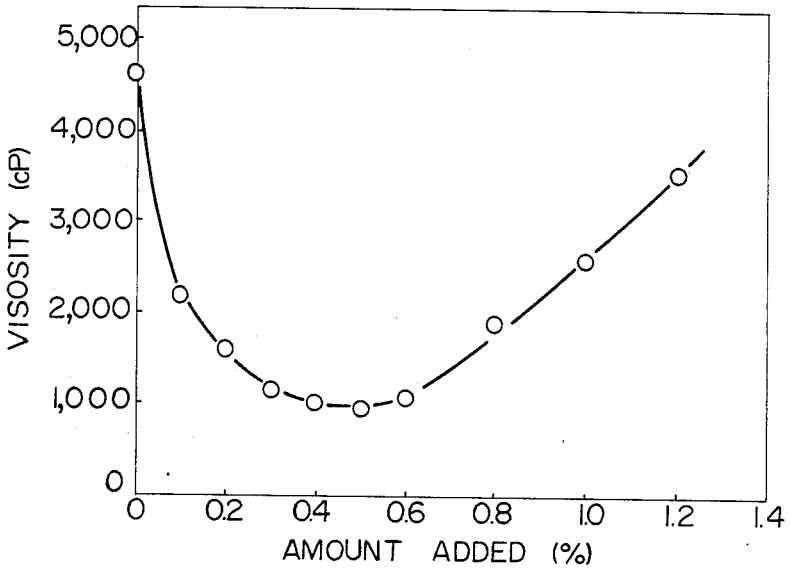
FIG. 5 shows a chart illustrating the relationship between the amount of dispersant added and viscosity.

With coal B (bituminous coal, ash content 13.6%), Example 1 was repeated to prepare a slurry having a particle size distribution corresponding to $D_L$=297 μm, $D_s$=0.01 μm and q=0.40 in the equation (1) and a coal concentration of 70%. A condensate of sodium napnthalinesulfonate as dispersant was added to the slurry to observe the relationship between its amounts added and the slurry viscosities. The results are shown in FIG. 5. In this case, the addition amounts are values based on the coal weight, and sodium hydroxide was added as pH adjustor in an amount of 0.1% based on the coal weight.

The viscosities became minimum in an addition amount of 0.5% of the dispersant, and more amounts resulted in an adverse effect.

Other kinds of coals were similarly studied, and the viscosities became minimum in addition amounts of 0.2~1.2%. When other anionic dispersants were added, slurries having a minimum viscosity was similarly obtained in addition amounts of 0.1~1.5%.

EXAMPLE 4

Figure 6:
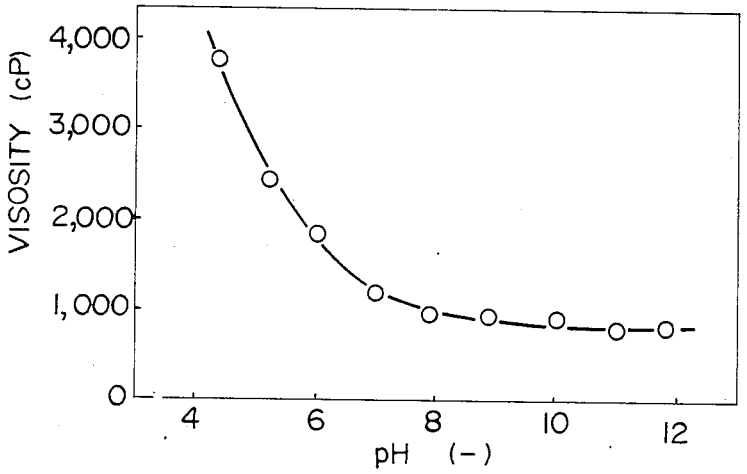
FIG. 6 shows a chart illustrating the relationship betweeen pH and viscosity.

With coal B (bituminous coal, ash content 13.6%), the same slurry as in Example 3 was prepared, followed by varying the amount of sodium hydroxide added, in a fixed amount of a condensate, of sodium naphthalenesulfonate added of 0.5% to adjust the pH of slurry to thereby study the influence of pH upon slurry viscosity. The results are shown in FIG. 6. Up to pH 8, the higher the pH, the lower the slurry viscosity, and at higher pHs, the viscosity is almost unchanged. Taking into consideration the amount of sodium hydroxide consumed and corrosion of material, a pH of 7~9 is preferred. In the case of coal, although the pH of slurry prepared therefrom varies depending on the kind of coal and the oxidation degree of its surface, the amount of sodium hydroxide added, necessary for adjusting the pH to 7~9, is about 0 to 1.0% based on the weight of coal.

EXAMPLE 5

Figure 7:
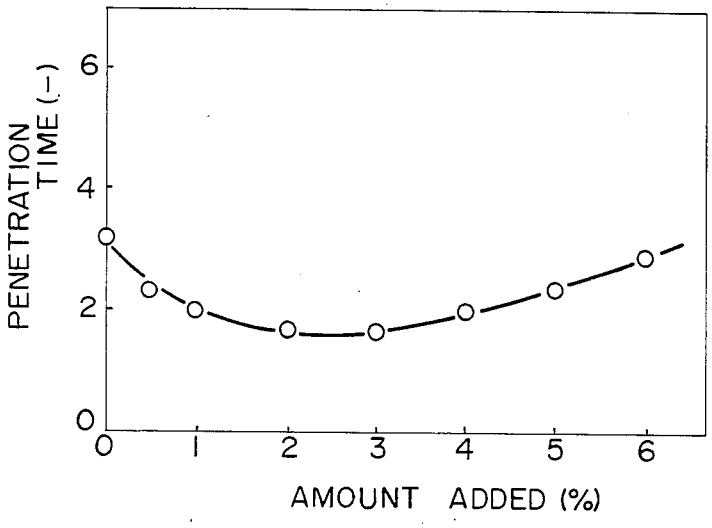
FIG. 7 shows a chart illustrating the relationship between the amount of ultrafine particles of 0.05 μm or less added and stability.

Ultrafine particles having passed through a millipore filter of 0.05 μm were further added to a slurry of coal B having a particle size distribution expressed by the equation (1) and corresponding to $D_L$=297 μm, $D_s$=0.01 μm and q=0.40, to study the influence of the ultrafine particles upon the stability of the slurry. The results are shown in FIG. 7. In this figure, the penetration time of the oridinate axis refers to a ratio of the penetration time in 30 days after preparation of slurry to that just after the preparation, and the amount of ultrafine particles added refers to a proportion thereof based on the total weight of coal after the addition.

The stability is best in an amount of the ultrafine particles added of 3%, and it is seen that particles of 0.05 μm or less contributed to the slurry stability. Studies were carried out varying the particle diameter distribution and the kind of coal. As a result it was found that the viscosity was unchanged when the weight of particles of 0.05 μm or less effective for improving the slurry stability fell within the range of about 0.5 to 6.5% (preferably 1.0 to 4.0%). Further, it was found that this tendency was unchanged even when the kind of coal, its concentration and $D_L$ were varied.

EXAMPLE 6

Figure 8:
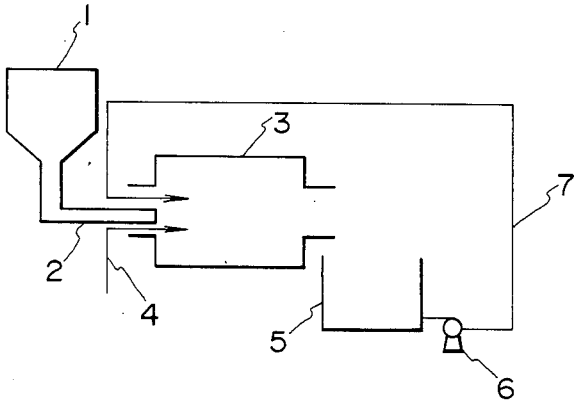
FIG. 8 shows a view of piping system illustrating an embodiment of an apparatus for producing CWM.
Figure 9:
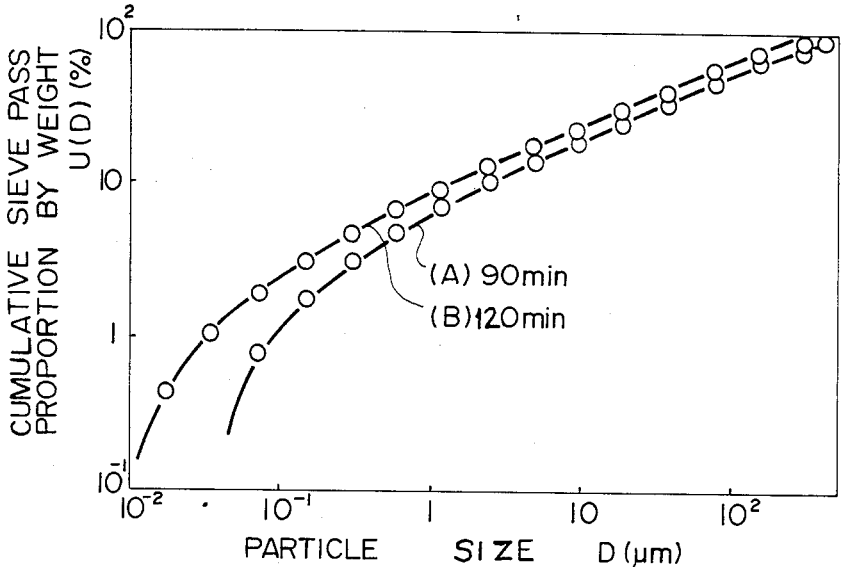
FIGS. 9 and 10 each show a chart illustrating the particle size of slurry produced by the apparatus of FIG. 8 and cumulative sieve pass proportion by weight.

With coal A (bituminous coal, ash content 9.5%), a process for preparing a slurry having a particle size distribution coresponding to the equations (1) and (2), by means of a tube ball mill (650 mm in diameter×250 mm in length) was studied. The apparatus and flow in this case are shown in FIG. 8. Coal stored in a bunker 1 was fed into a mill 3 through a feeder 2, and at the same time, water and additives were fed into the mill through a feed pipe 4. At that time, conditions were established so as to give a coal concentration of 70% and average retention times of coal in the mill, of 90 minutes and 120 minutes, and when a stationary state was attained, the resulting slurries were taken to observe their particle size distributions. The results are shown in FIG. 9. It is seen that the slurries had particle size distributions corresponding to $D_L$=420 μm, $D_s$=0.04 μm and q=0.40, and $D_L$=300 μm, $D_s$=0.01 μm and q=0.40 in the equation (2).

Figure 10:
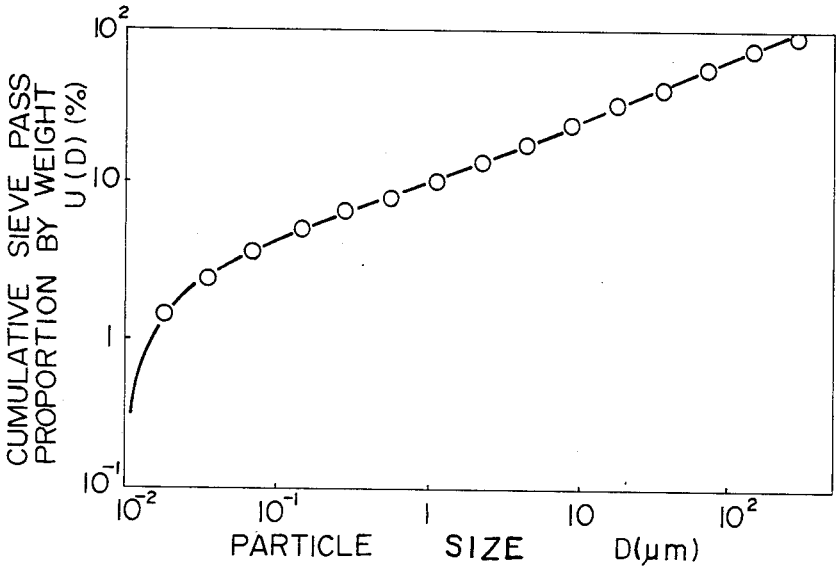

Next, 10% of the slurry of the average retention time of 120 minutes discharged from the exit of the mill was returned to the inlet of the mill and again ground. When a stationary state was attained, particle size were measured to give a particle size distribution corresponding to $D_L$=300 μm, $D_s$=0.01 μm and q=0.40 in the equation (1). See FIG. 10.

Other kinds of coals were similarly studied. As a result, it was found that in order to prepare a slurry having a particle size distribution according to the equation (1) and a good stability, it was impossible to achieve the object merely by adjusting the retention time in the mill, but a process fo recycling 10~50% of the product slurry (i.e. recycling feed) was effective.

In view of the above-mentioned Examples, it has been found that in order to obtain a CWM having a high coal concentration, a low viscosity and a good stability, if a strict and systematic control of the particle size distribution is conducted by means of sieves and the particle size distribution is caused to comply with the following equation, then the viscosity and stability of the resulting slurry becomes optimum:

$$U(D) = \left(\frac{D - D_s}{D_L - D_s}\right)^q \times 100$$

wherein q=0.25 to 0.50

$D_L$=44 to 420 μm $D_s$=0.005 to 0.1 μm

Further it has been found that when finely divided particles of 0.05 μm or less are present in an amount of 0.5 to 6.5% (preferably 1.0 to 4.0%), the slurry stability becomes optimum.

Furthermore it has been found that the amount of the dispersant added is optimum in 0.1 to 1.5% and it is preferred to add a pH adjustor so as to give a pH of 7 to 9.

When this invention is conducted, there is exhibited an effectiveness of rendering a mixture of water with powdered coal, a water-coal slurry having a high coal concentration, a low viscosity and a good stability with settings being difficulty formed.

What we claim is:

1. In the process for producing a coal-water slurry having coal particles dispersed in water, a process for producing a coal-water slurry having a high coal concentration, a low viscosity and a good stability, which process comprises causing the slurry to have a composition of coal particles having particle size in the range of 1,000 μm to 0.005 μm, so that when the coal particles are divided into 8 fractions ($F_1$, $F_2$, - - - and $F_8$), each fraction having a particle size range listed below wherein $D_L$ represents the maximum particle size of 1,000 μm of the coal particles, the proportions by weight of the coal particles contained in the respective fractions, relative to the total weight of the coal particles contained in the slurry falling within the following ranges of numeral values:

| | |
|---|---|
| $F_1$: ($D_L/4$ to $D_L$) | 29.0 to 50.0% by weight |
| $F_2$: ($D_L/4^2$) to less than $D_L/4$) | 20.0 to 25.0% by weight |
| $F_3$: ($D_L/4^3$ to less than $D_L/4^2$) | 12.0 to 15.0% by weight |

-continued

| | | |
|---|---|---|
| $F_4$: ($D_L/4^4$ to less than $D_L/4^3$) | 6.0 to 10.0% | by weight |
| $F_5$: ($D_L/4^5$ to less than $D_L/4^4$) | 3.0 to 12.0% | by weight |
| $F_6$: ($D_L/4^6$ to less than $D_L/4^5$) | 1.5 to 5.2% | by weight |
| $F_7$: ($D_L/4^7$ to less than $D_L/4^6$) | 0.8 to [4.9%]4.0% | by weight |
| $F_8$: ($D_L/4^7$ to 0) | 0.7 to 9.0% | by weight |

and adding a dispersant and pH-adjuster.

2. A process according to claim 1, wherein the particle size distribution of coal particles having particle size in the range of 1,000 μm to 0.005 μm substantially satisfies the following equation and the following ranges of numeral values:

$$U(D) = \left[\frac{D - D_s}{D_L - D_s}\right]^q \times 100 \quad (1)$$

$$D_L = 44 \sim 1{,}000\ \mu m \quad (2)$$

$$D_S = 0.005 \sim 0.1\ \mu m \quad (3)$$

$$q = 0.25 \sim 0.50 \quad (4)$$

wherein D represents a particle size of coal particles; $D_L$, the maximum particle size thereof; $D_s$, the minimum particle size thereof; and q, an index.

3. A process according to claim 1, wherein the slurry is composed so that coal particles of 1 μm or less can be present in an amount of 5 to 46% by weight and those of 0.05 μm or less can be present in an amount of at least 0.5% by weight.

4. A process according to claim 1, wherein the slurry is pumped through a pipeline and has a coal content of 60 to 80% by weight and a viscosity of at least 5,000 cP, in terms of numeral values obtained when an inner cylinder-rotation type viscometer is rotated at a shear rate of 90 $sec^{-1}$ for 5 minutes.

5. A process according to claim 4, wherein the dispersant is at least one kind of anionic dispersant selected from the group consisting of naphthalenesulfonic acid, orthophosphoric acid, polyphosphoric acids represented by $H_3PO_4$, $(HPO_3)_6$, $H_4P_2O_7$, tartaric acid, oxalic acid, citric acid, ethylenediamine tetraacetate, ligninsulfonic acid, salts and condensates of the foregoing, tannins including quebracho-tannin and metal salts of carboxymethylcellulose, and is added to the slurry, as a dispersant for coal particles in an amount of up to 3% weight based on the coal weight.

6. In the process for producing a coal-water slurry having coal particles and at least one dispersant and pH-adjuster dispersed in water, a process for producing a coal-water slurry having a high coal concentration, a low viscosity and a good stability, which process comprises causing the slurry to have a composition of coal particles, wherein the particle size distribution of the coal particles is in the range of 300 μm to 0.005 μm and substantially satisfies the following equation and the following ranges of numeral values:

$$U(D) = \left(\frac{D - D_s}{D_L - D_s}\right)^q \times 100 \quad (1)$$

$$D_L = 44 \sim 300\ \mu m \quad (2)$$

$$D_s = 0.005 \sim 0.1\ \mu m \quad (3)$$

-continued $$q = 0.25 \sim 0.50 \quad (4)$$

wherein D represents a particle size of coal particles; $D_L$, the maximum particle size thereof; $D_s$, the minimum particle size thereof; and q, an index.

7. A process according to claim 6, wherein the dispersant is at least one of anionic dispersants selected from the group consisting of naphthalenesulfonic acid, orthophosphoric acid, polyphosphoric acids represented by $H_3PO_4$, $(HPO_3)_6$, $H_4P_2O_7$, tartaric acid, oxalic acid, citric acid, ethylenediamine tetraacetate, lignin sulfonic acid, salts and condensates of the foregoing, tannins including quebracho-tannin and metal salts of carboxymethylcellulose, and is added to the slurry, as a dispersant for coal particles in an amount of up to 3% by weight based on the coal weight.

8. A process according to claim 7, wherein the pH-adjuster is at least one kind of pH-adjuster selected from the group consisting of sodium hydroxide, potassium hydroxide, barium hydroxide and sodium carbonate and is added to the slurry as a pH-adjuster for rendering the pH value of the slurry at least 7, in an amount of up to 3% based on the coal weight.

9. A process according to claim 6, wherein the pH-adjuster is at least one kind of pH-adjusters selected from the group consisting of sodium hydroxide, potassium hydroxide, barium hydroxide and sodium carbonate and is added to the slurry as a pH-adjuster for rendering the pH value of the slurry at least 7, in an amount of 3% or less based on the coal weight.

10. A process according to claim 6, wherein the slurry is composed so that the coal particles of up to 1 μm can be present in an amount of 5 to 46% by weight and those of 0.05 μm or less can be present in an amount of at least 0.5% by weight.

11. A process according to claim 6, wherein the slurry is pumped through a pipeline and has a coal content of 60 to 80% by weight and a viscosity of at least 5,000 cP, in terms of numeral values obtained when an inner cylinder-rotation type viscometer is rotated at a shear rate of 90 $sec^{-1}$ for 5 minutes.

12. A process for producing a coal-water slurry having coal particles and at least one dispersant and pH-adjuster dispersed in water, comprising the steps of:

measuring the distribution of coal particle sizes in a coal-water slurry by dividing the coal particles into eight fractions ($F_1$, $F_2$, $F_3$ . . . and $F_8$) with each fraction having a particle size range, respectively, of:

| | |
|---|---|
| $F_1$: | ($D_L/4$ to $D_L$), |
| $F_2$: | ($D_L/4^2$ to less than $D_L/4$), |
| $F_3$: | ($D_L/4^3$ to less than $D_L/4^2$), |
| $F_4$: | ($D_L/4^4$ to less than $D_L/4^3$), |
| $F_5$: | ($D_L/4^5$ to less than $D_L/4^4$), |
| $F_6$: | ($D_L/4^6$ to less than $D_L/4^5$), |
| $F_7$: | ($D_L/4^7$ to less than $D_L/4^6$), and |
| $F_8$: | ($D_L/4^7$ to $D_S$); |

adjusting the distribution of coal particles sizes U(D) in the slurry to satisfy the following equation:

$$U(D) = \left[\frac{D - D_s}{D_L - D_s}\right]^q \cdot 100,$$

wherein:

-continued $$44\ \mu m \leqq D_L \leqq 300\ \mu m \quad (1)$$

$$D_S \leqq 0.1\ \text{um, and} \quad (2)$$

$$0.25 \leqq q \leqq 0.50, \quad (3)$$

with D representating a particle size of coal particles $D_L$ representating the maximum particle size, $D_S$ representating the minimum particle size, and q an index, and with U(D) representating distribution in percentage by weight relative to the total weight contained within the slurry; and adding dispersant and pH adjuster to the slurry.

13. The process of claim 12, further comprised of adjusting the distribution of coal particle sizes to satisfy the equation with $0.40 \leqq q \leqq 0.45$.

14. The process of claim 12, further comprised of adjusting the distribution of coal particle sizes to satisfy the equation with $0.40 \leqq q \leqq 0.50$.

* * * * *